US007636975B2

(12) United States Patent
Mah et al.

(10) Patent No.: US 7,636,975 B2
(45) Date of Patent: Dec. 29, 2009

(54) POOL VACUUM

(75) Inventors: Pat Y. Mah, Kowloon (HK); Alexander Joseph Kalogroulis, Coulsdon (GB); Matthew Edward White, Balcombe (GB)

(73) Assignee: Hydrodynamic Industrial Company Limited, Hong Kong (HK)

( * ) Notice: Subject to any disclaimer, the term of this patent is extended or adjusted under 35 U.S.C. 154(b) by 0 days.

(21) Appl. No.: 11/595,675

(22) Filed: Nov. 9, 2006

(65) Prior Publication Data

US 2008/0109972 A1 May 15, 2008

(51) Int. Cl.
*E04H 4/16* (2006.01)

(52) U.S. Cl. ..... 15/1.7; 15/350; 15/415.1; 15/344; 210/416.2

(58) Field of Classification Search ..... 15/1.7, 15/350, 415.1, 344, 328, DIG. 1; 210/169, 210/416.2, 167.16, 238; D32/17, 18
See application file for complete search history.

(56) References Cited

U.S. PATENT DOCUMENTS 4,835,452 A * 5/1989 Kuriyama ..... 320/114
4,962,559 A * 10/1990 Schuman ..... 15/1.7
5,056,186 A * 10/1991 Jiam-Fa ..... 15/328
D355,058 S * 1/1995 Phelan ..... D32/18
D379,690 S * 6/1997 Howell et al. ..... D32/18
5,842,243 A * 12/1998 Horvath et al. ..... 15/1.7
6,797,157 B2 9/2004 Erlich
6,939,460 B2 9/2005 Erlich
7,060,182 B2 6/2006 Erlich et al.
2004/0094083 A1* 5/2004 Mazin ..... 114/315
2005/0247613 A1* 11/2005 Bishop et al. ..... 210/169

FOREIGN PATENT DOCUMENTS

GB 2253512 * 9/1992

* cited by examiner

*Primary Examiner*—Gary K Graham
(74) *Attorney, Agent, or Firm*—Raymond Sun

(57) ABSTRACT

An improved pool vacuum includes a filter cone and poppet valve combination which enables quick drainage of water which has passed through and been cleaned by the cleaner's filter. A charging circuit is provided with isolation so that the pool vacuum can be used in an electrolytic environment without battery drainage. A combination charger and hang bracket enables the pool vacuum to be stored in a vertical position to both drain and charge simultaneously. An interstitial open exhaust gap between a rear body and nose-cone shaped front section provides a low pressure drop free exhaust area for an impeller. An optionally obstructed bottom gap portion helps to produce a net downward thrust to assist in using the vacuum in deep pools from a long pole structure.

16 Claims, 9 Drawing Sheets

POOL VACUUM

FIELD OF THE INVENTION

The present invention relates to an improvement in pool vacuums which facilitates deployment of the device, use of the device, and ease of stowage and cleaning.

BACKGROUND OF THE INVENTION

Conventional pool cleaning devices move water through a filter or trap system over a short distance from an inlet adjacent a surface to area to be cleaned, while expelling the water back into the pool environment. The placement of the pump within a vacuum unit eliminates the need to move water over a long distance or over a distance of vertical head. The ability to intake and expel the water from which the debris has been removed essentially eliminates energy which would have to overcome the pressure head. Thus only enough force is needed to move the water kinetically fast enough to provide a "sweeping" operation and to overcome the pressure drop due to the filter is needed.

However, placement of the drive motor in a submerged position means that the delivery of power will be a problem. Usage of a battery would mean dis-assembly to change the battery. Usage of straight power could cause shock or electrocution. Use of a battery with a recharge line could present electrolysis problems which could lead to explosion/ignition. Use of a resealable port to access charging conductors could present problems with water ingress and electrolysis In addition, the ergonomic challenges of prior pool vacuums have limited their individual utility for various applications. Operating handles of conventional vacuums have made it difficult to use most commercially available models for both deep pool and shallow pool applications. Operation with spas can be even more difficult without the ability to be manipulated more locally.

Another problem with most commercial pool vacuum units is the ability to introduce water into the pumping and filter chambers upon submersion and the ability to dump water, especially without filter trapped debris, during removal from the submersed condition for storage.

SUMMARY OF THE INVENTION

An improved pool vacuum includes a filter cone and poppet valve combination which enables quick drainage of water which has passed through and been cleaned by the cleaner's filter. A charging circuit is provided with isolation so that the pool vacuum can be used in an electrolytic environment without battery drainage. A combination charger and hang bracket enables the pool vacuum to be stored in a vertical position to both drain and charge simultaneously. An interstitial open exhaust gap between a rear body and front nose-cone section provides a low pressure drop free exhaust area for an impeller. An optionally obstructed bottom gap portion helps to produce a net downward thrust to assist in using the vacuum in deep pools from a long pole structure. The same obstructed bottom gap, when used inverted, limits the impaired visibility caused by ripples on the surface of a shallow pool. Use of the pool vacuum with varying sizes of extensions between a handle and a handle bore fitting formed integral with a rear housing or with a very long pool pole is shown.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
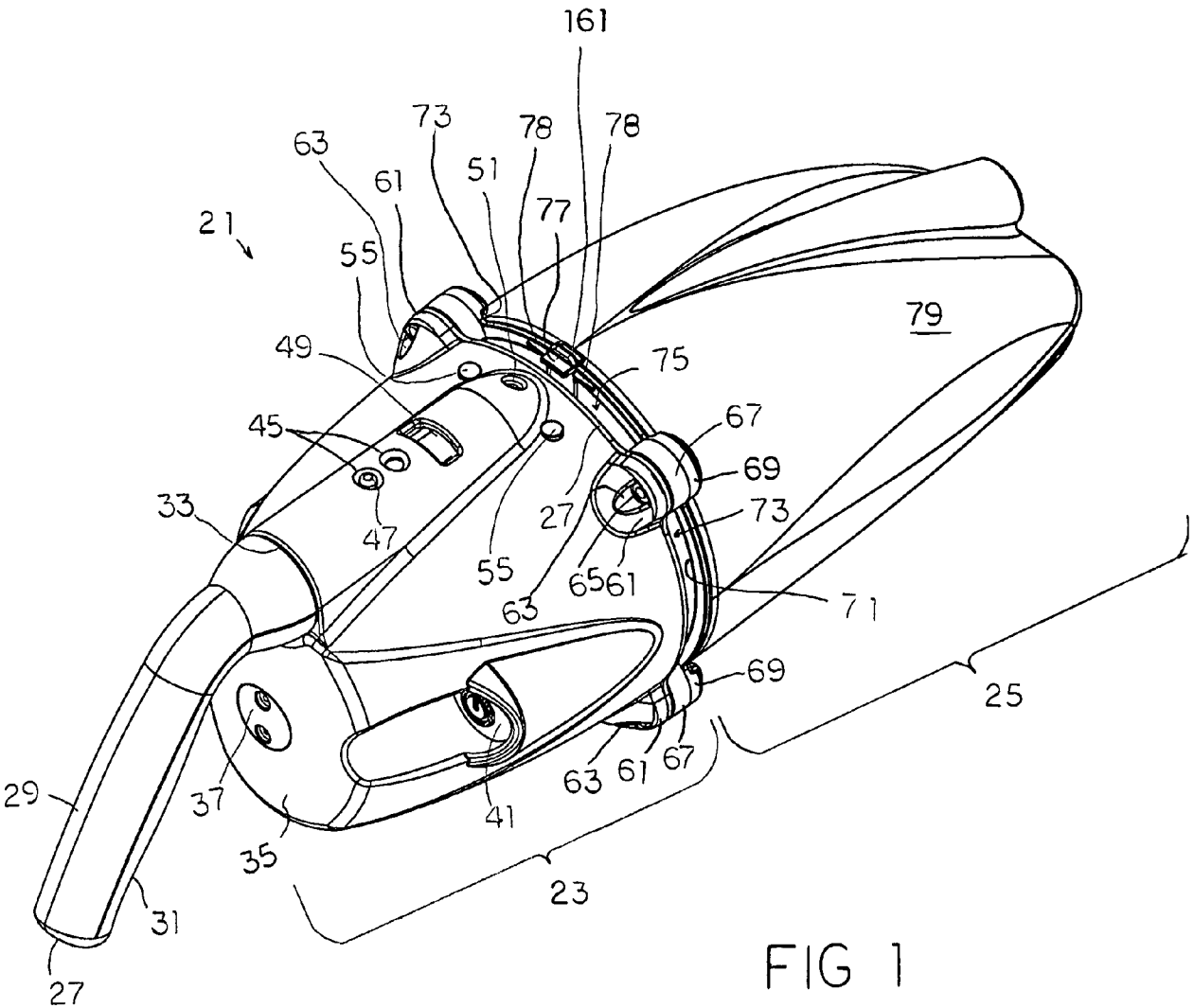
FIG. 1 is a rear perspective showing the right side of the pool vacuum with the main handle located to the lower left.

The description and operation of the pool vacuum of the invention will begin to be best described with reference to FIG. 1 which illustrates an exterior view of a pool vacuum 21 seen as having a rear body housing 23 and a nose-cone shaped front housing section 25. The construction of the pool vacuum 21 is somewhat modular with the rear body housing 23 including the mechanics and structural connections, while the nose-cone shaped front housing section 25 includes a filter cone, and water inlet. Water is expelled from a narrow space between the rear body housing 23 and a nose-cone shaped front housing section 25, as will be described.

At the left side of the rear body housing 23, a handle 27 may include an upper section 29 and a lower section 31 which may fit bayonet style into a handle bore fitting 33. The inclusion of handle bore fitting 33 as an integral part of the rear body housing 23 brings it closer to the centerline of the pool vacuum 21 with resulting ease of handling and elimination of angled fittings which could have an enhanced probability of catching on objects and corners and pool structures. The bayonet style fit enables users to adjust handles and attachment poles (as will be shown) to obtain an optimum ergonomic fit and better utilization of the pool vacuum 21. Underneath the handle bore fitting 33, a rear end 35 of the rear body housing 23 a gas relief valve cover 37 is seen which is part of a check valve to allow any pressure build-up within the rear body housing 23 to escape, but preventing any surrounding water from entering the rear body housing 23.

About ⅓ the way toward the front of the rear body housing 23, a flexible switch diaphragm 41 is seen. At the top of the rear body housing 23, and on a structure which is optionally seen as somewhat continuous forward of the handle bore fitting 33, a pair of apertures 45 are seen which may accommodate one or more locking buttons 47 such as a depressible spring locking button which is urged upwardly to partially protrude through one of the locking apertures 45 to secure the handle 27 within the 33. A curved slot 49 is seen which may be used with a hanging bracket to facilitate an out-of-the way storage for the pool vacuum 21. At the forward most extent of the somewhat continuous forward of the handle bore fitting 33, a drainage hole 51 is seen as an exit port for enabling any water which collected within the somewhat continuous forward of the handle bore fitting 33 to drain, especially when the pool vacuum 21 is stored on a bracket via curved slot 49 with the nose-cone shaped front housing section 25 directed downwardly.

A pair of charging contacts 55 are seen on either side of a raised structure such as the one seen between the curved slot 49 and drainage hole 51 reduces the possibility of inadvertent contact between the charging contacts 55, such as with a metal plate or pole which may be handled near the pool vacuum 21. This type of arrangement may also lessen the probability that a user might try and attempt to charge the pool vacuum 21 with an improper charger with improper voltage or amperage.

The rear body housing 23 has a series of four angled fittings 61, each having a linear cutout 63 for admitting a bolt 65. Just forward of the four angled fittings 61, a spacer 67 sets the separation between the four angled fittings 61 of the rear body housing 23 and a series of four filter cone housing fittings 69 which are attached to or formed integrally with a cone plate 71. The spacers 67 can be formed integrally with either the four angled fittings 61 or the series of four filter cone housing fittings 69. Where the spacers 67 are formed integrally with the four angled fittings 61 the extent of the forward most extent of the rear body housing 23 will be extended forward, and where the spacers 67 are formed integrally with the series of four filter cone housing fittings 69 the rearward extent of the nose-cone shaped front housing section 25 will be extended rearwardly.

The four filter cone housing fittings 69 are further important because they each include an inwardly directed capture slot 73 which rotatably admit a locking tab, as will be explained.

In either of these three cases, a gap 75 may be formed completely about the connection of the rear body housing 23 with the nose-cone shaped front housing section 25, interrupted only by the existence of the periodically appearing four angled fittings 61, spacers 67 and series of four filter cone housing fittings 69, or the gap may exist on the upper side and two lateral sides with the bottom gap covered by an interfering plate or obstruction. It is understood that depending on size and orientation that the peripheral connection of the rear body housing 23 with the nose-cone shaped front housing section 25 can have one, two, three, four, five or six sets of the angled fittings 61, spacers 67 and series of four filter cone housing fittings 69.

One aspect of even placement of the angled fittings 61, spacers 67 and series of four filter cone housing fittings 69 is that the gaps 73 which open circumferentially around the periphery of the pool vacuum 21 at the junction between the rear body housing 23 and the nose-cone shaped front housing section 25 form an even filtered water exhaust. Where the filtered water exhaust is expelled evenly in all directions, there should be no net force on the pool vacuum 21 to move in one direction or the other with all post-filtration exhaust flow being in all directions. The gap 75 is generally quite narrow and is of a size which will not enable fingers or hands to contact any moving parts. However, as mentioned above it is preferable to block the bottom gap so that, assuming that the lateral openings of the gap 71 have even output thrust, the upper side of the gap 71 produces a net downward thrust. As will be seen, the net downward thrust can assist the user in operating the pool vacuum 21 with a long pole.

Generally speaking, cone plate 71 provides the most significant structural connection of the nose-cone shaped front housing section 25 onto the rear body housing 23. In some cases other structural components of the nose-cone shaped front housing section 25 can be attached either permanently or temporarily to the rear body housing 23, but the technique of dependence of the other components of the nose-cone shaped front housing section 25 onto the cone plate 71 makes for some additional simplicity of construction and operation.

At the top of the cone plate 71 is a latch 77 which can be used to disengage a filter cone housing member 79 away from the cone plate 71. Latch 77 lies between two shallow rearward projections 78 which can not only be used to form a shallow operating path for the latch 77 but also to engage a pair of hooks in a charging bracket which will be shown in FIG. 8.

As has been explained, the cone plate 71 is attached to the rear body housing 23 with the use of four angled fittings 61 and four filter cone housing fittings 69 with the possibility of an optional spacer 67 where neither the angled fittings 61 nor the filter cone housing fittings 69 have enough forward or rearward material, respectively, to maintain the gap 75.

The filter cone housing member 79 rotates about it axis to cause a series of matching projections (not seen in FIG. 1) to be lockably captured within the inwardly directed capture slots 73. In this configuration, the open end of the filter cone housing member 79 is brought toward the four fittings in a position rotated about thirty to forty degrees about the axis taken with respect to the poppet valve element 85, so that the outwardly extending matching projections (not seen in FIG. 1) approach the cone plate 71 out of alignment with respect to the series of four filter cone housing fittings 69. Once the open end of the filter cone housing member 79 is brought flush with the cone plate 71, the filter cone housing member 79 is turned to cause the extending matching projections (not seen in FIG. 1) to fit within the inwardly directed capture slots 73 to affix the filter cone housing member 79 with respect to the cone plate 71.

As the filter cone housing member 79 is turned about its axis to a position where all of the extending matching projections (not seen in FIG. 1) are brought within their associated inwardly directed capture slots 73, the spring urged latch 77 snaps into a complementary slot formed in the rear open face of the filter cone housing member 79 to lock the filter cone housing member 79 into place. The latch 77 prevents the filter cone housing member 79 from turning to a position where the extending matching projections (not seen in FIG. 1) are disengaged from their associated inwardly directed capture slots 73 within the series of four filter cone housing fittings 69. Thus the filter cone housing member 79 is actually firmly structurally supported by the series of four filter cone housing fittings 69, and the latch 77 requires very little force to prevent any inadvertent twisting of the filter cone housing member 79 out of alignment. Latch 77 fits into a first complementary slot 161. A second complementary slot 162 (not seen in FIG. 1 but shown in FIG. 5) formed in the rear open face of the filter cone housing member 79 at 180 degrees to the first complementary slot 161 permits the filter cone housing member 79 to be assembled in a second orientation at 180 degrees to that which is shown.

Figure 2:
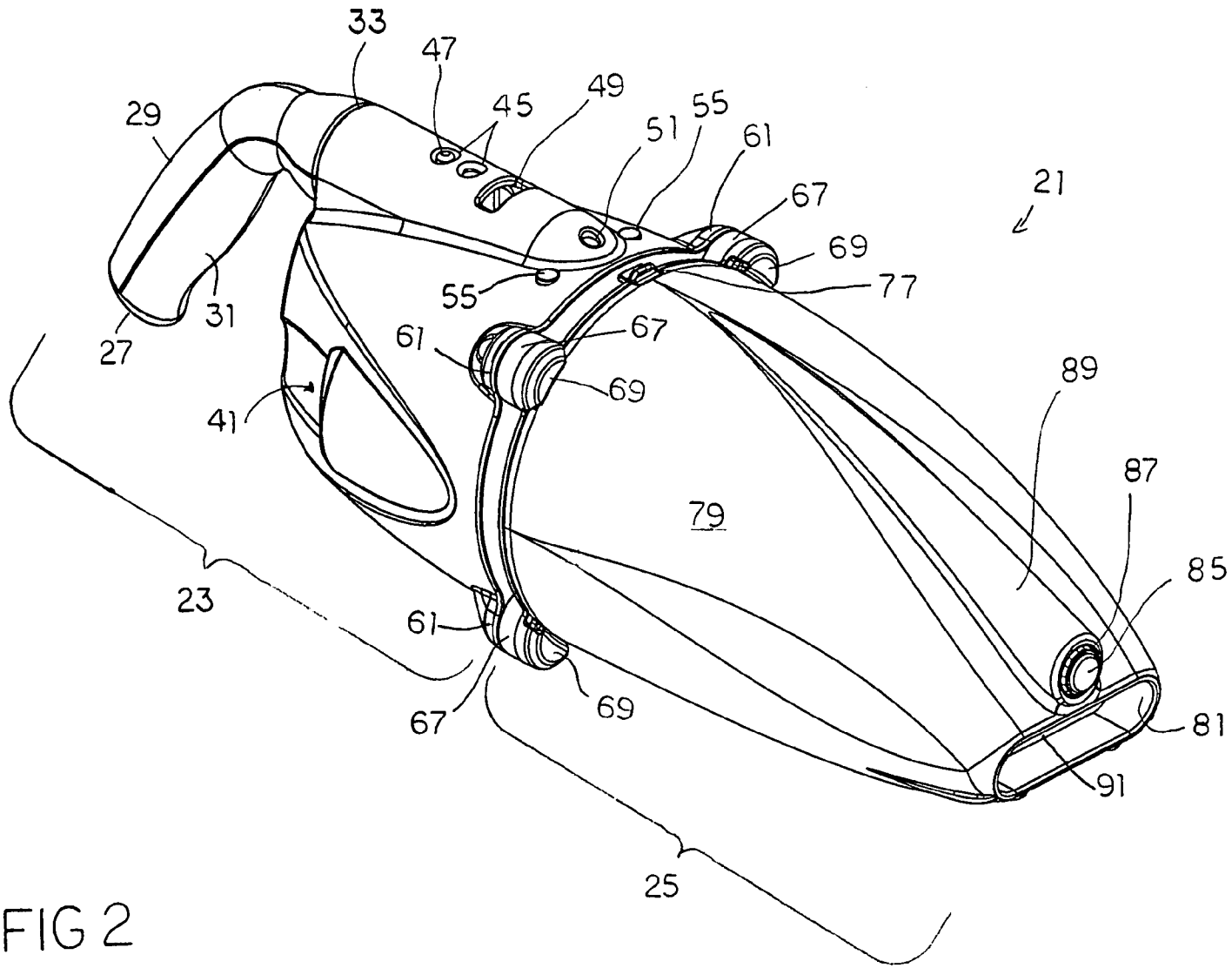
FIG. 2 is a front perspective showing the right side of the pool vacuum with the main handle located to the upper left.

Referring to FIG. 2, a front perspective showing the right side of the pool vacuum 21 with the handle 27 located to the upper left, reveals more details of the front end of the filter cone housing member 79. The front end of the filter cone housing member 79 includes an oval water intake opening 81. Oval water intake opening 81 is a wide suction mouth with a lower portion of the opening which may be recessed with respect to the upper portion of the opening, and which eliminates the need for bulky specialized inlet nozzles and their attachments, conduits and other pressure-drop consuming attachments. The filter cone housing member 79 and or the oval water intake opening 81 may include a material which is resistant to wear. The oval water intake opening 81 may be used at an angle with respect to the bottom or sides of a swimming pool or spa, or nearly flat against the oval water intake opening 81.

With regard to the overall generally circular front profile of the pool vacuum 21 the oval water intake opening 81 is located below center and has a width which is between less than half of the widest width of the pool vacuum 21, but slightly more than one third the width of the pool vacuum 21. At the center top of the filter cone housing member 79 a poppet valve element 85 is seen within a poppet valve opening 87 which is formed in a bulge 89 in the filter cone housing member 79.

The arrangement, which will be shown in further detail, is the availability of drainage in a manner in which forces any residual water to drain from the intake only after it has been filtered. A rubber flap valve 91 is only slightly seen in the perspective view seen in FIG. 2. This rubber flap valve 91 bends to an open position to enable inlet water to filter through a cone filter (not seen in FIG. 2) when the pool vacuum 21 is operating. The rubber flap valve 91 closes when the pool vacuum 21 is not operating. Further, suction operation urges poppet valve element 85 into a sealing relationship with respect to the poppet valve opening 87 when the pool vacuum 21 is operating. When the pool vacuum 21 is removed from a body of water and turned downward putting rear body housing 23 in a vertical position over nose-cone shaped front housing section 25, water within the filter cone housing member 79 can only exit through the poppet valve opening 87 after the poppet valve element 85 is displaced by gravity. As will be shown, the only water when can exit the poppet valve opening 87 is water which has been filtered.

Figure 3:
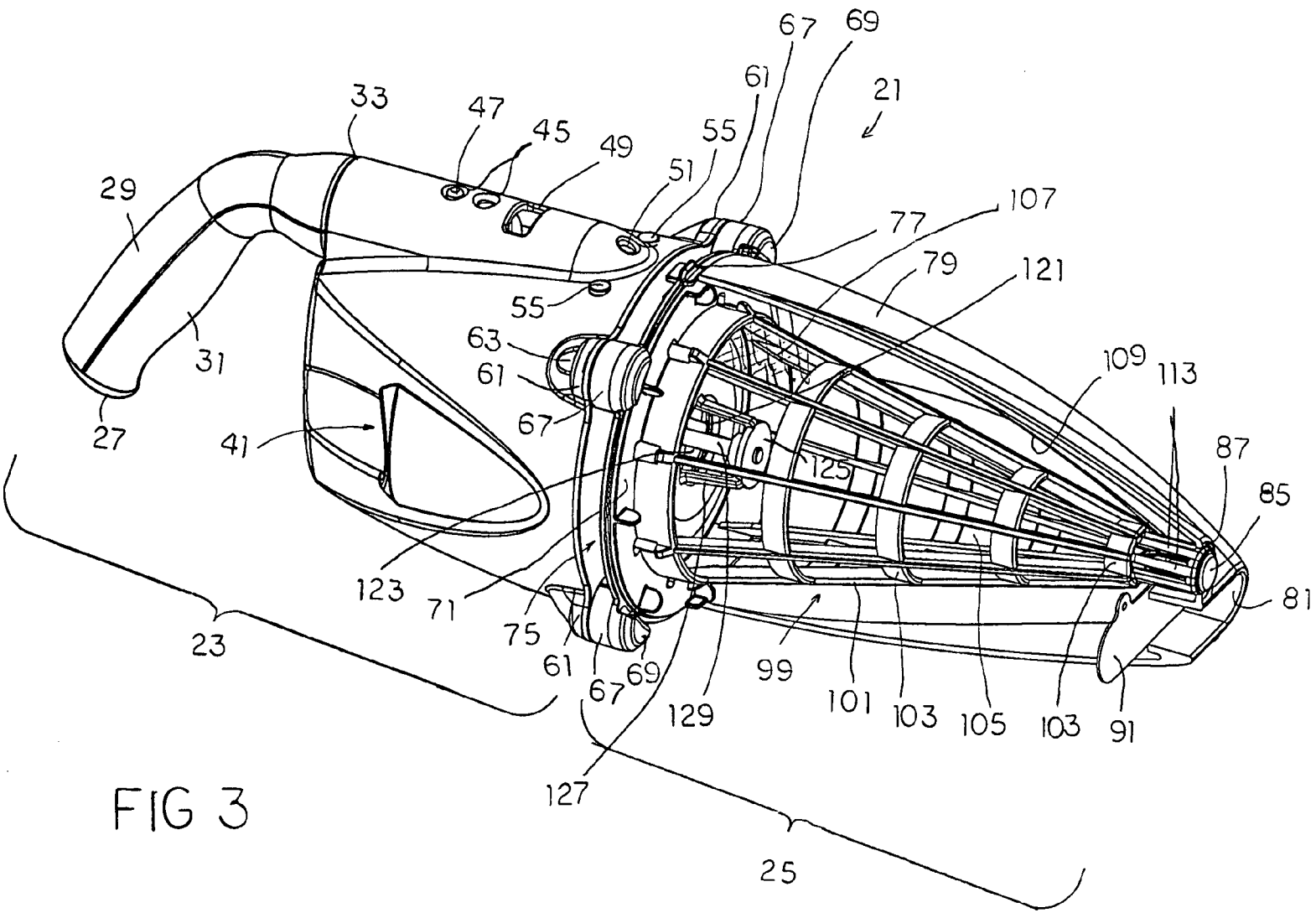
FIG. 3 is a front perspective showing the right side of the pool vacuum with the main handle located to the upper left similar to that seen for FIG. 2, but with a portion of the filter cone housing member removed to expose an expanded skeletal structure covered with filter material.

Referring to FIG. 3, a perspective view is shown which differs slightly from FIG. 2 in terms of angle, but in which half of the filter cone housing member 79 has been removed to show further internals. As can be seen, the cone plate 71 supports an expanded skeletal structure 99 which includes longitudinal ribs 101 periodically connected to a series of ring supports 103. The bulk of the overall area of the expanded skeletal structure 99 is made up of interstitial water passages 105. A small area of filter material 107 is shown covering one of the expanded interstitial water passages 105, and is not shown covering the other interstitial water passages 105 purely for convenience and to illustrate the internals. The filter material 107 may be a fine filter be made from a fine meshed fabric. In actual use and operation, all of the interstitial water passages 105 will be covered by either a large number of areas of filter material 107 or a large enveloping sheath of filter material 107. In many cases, a frusto-conical "bag" of filter material 107 will be provided so that any breach of the filter or wear over time will enable the "bag" of filter material 107 to be replaced. In other instances, the whole cone plate 71 can be provided as a replacement item with the filter material 107 fused to it.

At the forward end of the expanded skeletal structure 99 a forward most ring support 103 forms the terminal end of the expanded skeletal structure 99. This forward most ring support 103 is seen as contacting an optional inner wall 109 which may be present to more closely approximate a guided flow with respect to the expanded skeletal structure 99 as well as for increased structural integrity for the filter cone housing member 79.

The Expanded area of the filter material 107 over the expanded skeletal structure 99 which supports the filter material 107 to provide an expanded filter area and expanded water flow area assumes that there will be enough space between the optional inner wall 109 and the outside surface of the filter material 107 to create an even filtering flow. Further, by providing an expanded area of filter material 107, the pressure drop of water passing through the filter cone housing member 79 is reduced, and the individual physical pushing pressure each area of filter material 107 is reduced. In turn, this reduces the probability of rupture and extends the life of the filter material 107.

In the alternative, the filter cone housing member 79 could be manufactured to have a shape which more closely approximates the outer, and therefore inner shape of a filter cone housing member 79. The forward most ring support 103 is shown as contacting one or more inner structures such as optional inner wall 109, as an optional example, or at least preventing entry of any debris into the forward most ring support 103.

This need is combined with a drainage feature which uses the poppet valve element 85 in conjunction with other surrounding structures which provide closure to the opening of the forward most ring support 103. The poppet valve element 85 is placed in a position with surrounding structures to form sealing closure of the forward most ring support 103. The poppet valve element 85 has rearwardly extending fingers, possibly joined for greater strength (not seen in FIG. 3). An extension structure 113 beyond the forward most ring support 103 provides a short easy travel for the poppet valve element 85. When the poppet valve element 85 slides forward and out of the poppet valve opening 87, the circumferential spaces between any structural element which holds the poppet valve element 85 inside the poppet valve opening 87 forms a drainage path of any water otherwise trapped inside the expanded skeletal structure 99.

The poppet valve element 85 will not fall completely out of the poppet valve opening 87 because it has a rearward structure with fingers which are notched to engage the inside of the poppet valve opening 87 and will be retained within the poppet valve opening 87 while allowing water to drain from within the expanded skeletal structure 99 which is covered by the filter material 107.

Any debris laden water between the filter material 107 and the optional inner wall 109 will have no exit other than through the filter material 107 and into the expanded skeletal structure 99 to exit through the forward most ring support 103 poppet valve opening 87 and through the notched retention fingers (not shown in FIG. 3) of the poppet valve element 85, after the poppet valve element 85 is moved forward and out of a sealing position with respect to the poppet valve opening 87. When stored in a vertical position, the poppet valve element 85 will tend to remain open and allow the internals within the nose-cone shaped front housing section 25 to dry.

Upon initial re-deployment of the pool vacuum 21, water will enter the filter cone housing member 79 both through an opening 121 in the cone plate 71 (in a direction opposite that through which water is normally drawn) as well as through the poppet valve opening 87 to the extent that poppet valve element 85 remains forwardly deployed, and also through the rubber flap valve 91 to the extent that pool vacuum 21 is immersed rapidly enough to overcome its bending resistance. If pool vacuum 21 is held under water in a vertical orientation for a few seconds, especially in the vertical position with the poppet valve element 85 pointing upward, all of the air in the filter cone housing member 79 will bubble out of the poppet valve opening 87. The flooding of the filter cone housing member and gap 75 is needed for an impeller 123, which is only partially observable adjacent the adjacent aperture 121, helps the pool vacuum 21 to operate properly from the start and will eliminate any jerky motion or noise and vibration from air bubbles or air pockets at the start of operation. Once the filter cone housing member 79 is filled with water and the pool vacuum 21 is switched on, water is begun to be withdrawn through the expanded skeletal structure 99. The pull of water from the center of the expanded skeletal structure 99 most directly affects the poppet valve element 85 which has almost no resistance to sliding into and out of the poppet valve opening 87, but also starts water flow through the oval water intake opening 81. As soon as any water pull is experienced by the poppet valve element 85, it is immediately pulled back into a sealing relationship with respect to the poppet valve opening 87, and normal vacuuming operation commences.

Other details surrounding the aperture 121 are also seen. A bearing 125 is supported away from the main surface of the cone plate 71 to enable water to rush around the bearing 125 and through the aperture 121. The bearing 125 is supported by struts 127. Bearing 125 rotatably supports a shaft 129. The shaft 129 is driven by a motor (not shown in FIG. 3) and rotatably supports the impeller 123. Impeller 123 is typically a plate with a series of radially extending (straight or curved) vanes which use centrifugal force to spin the water toward and to exit from the gap 75. It is understood that some axial rotational torque can be experienced where the design causes water to leave the gap 75 at an angle with respect to a line extending straight away from the shaft. This turning thrust can be countered with static exit vanes which act to counteract the spinning effect of the impeller 123. This is an optional structure which may or may not be chosen for inclusion in the gap 75 depending upon either the speed of the impeller 123, the curvature of the driving blades of the impeller 123 and whether the design of the overall system contemplates the ability to make up for any lost energy which is consumed in straightening the exit from the slot 71.

Figure 4:
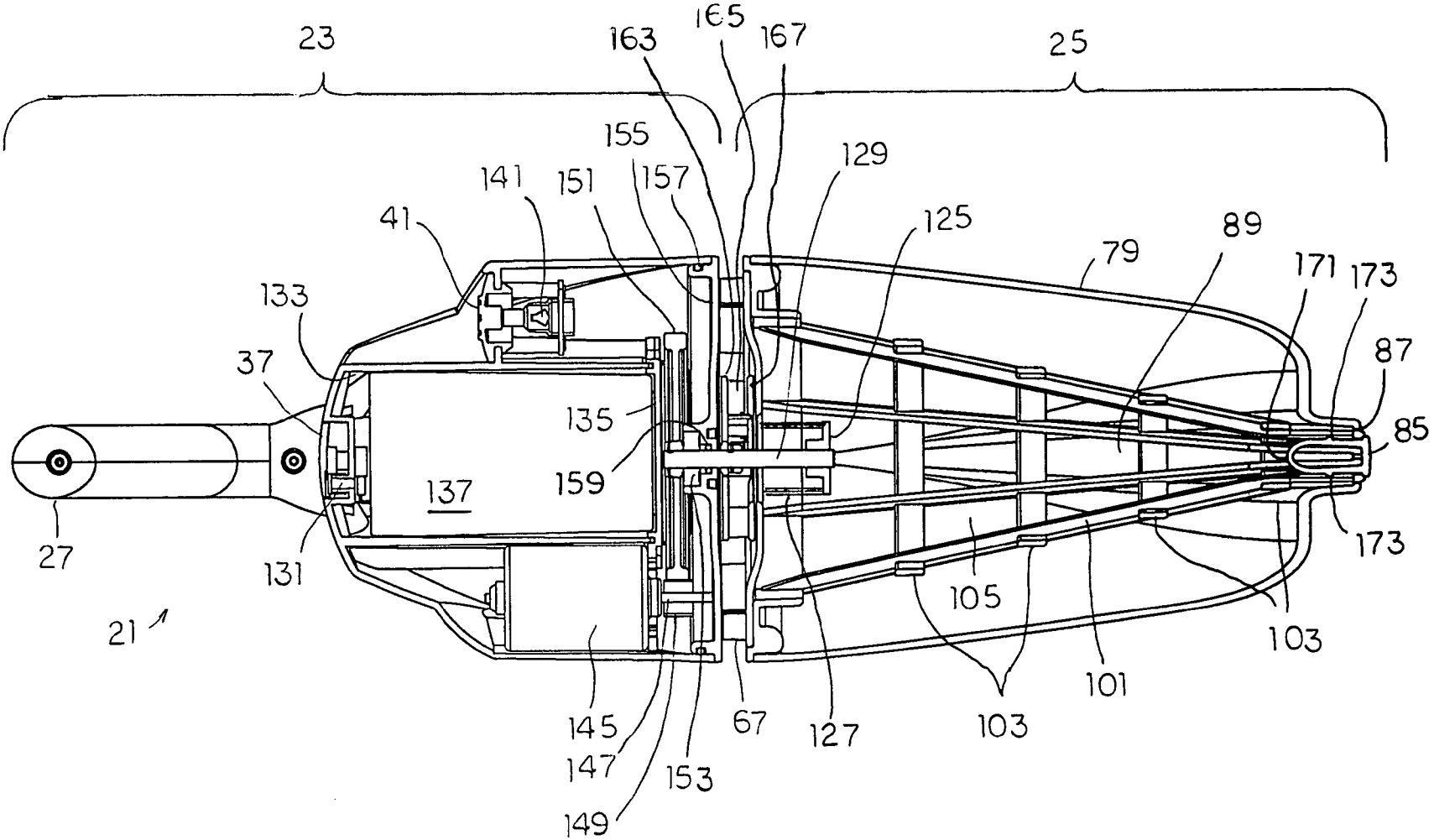
FIG. 4 is a bottom half sectional view into the top of the pool vacuum with the bottom half of the pool vacuum removed taken along the axis of the main shaft.

Referring to FIG. 4, a bottom half sectional view is shown with the bottom of the pool vacuum 21 below the centerline of the shaft 129 removed. The filter material 107 is also completely removed so as not to obscure the view. This view into the top section reveals the general arrangement of the components within the pool vacuum 21. Beginning from the left, the gas relief valve cover 37 is seen next to a gas relief valve 131. Gas relief valve 131 leads into a battery compartment 133. At the far end of the battery compartment 133 is a battery seal plate 135 which surrounds a battery 137. The battery compartment 133 and battery seal plate 135 forms a gas tight volume around the battery 137 with a single gas passage being sealed by a gas relief valve 131 and gas relief valve cover 37. Any hazardous gas or pressure created by the battery 137 therefore has a route out from the sealed battery chamber.

The flexible switch diaphragm 41 leads mechanically to a switch 141 which is electrically connected to power a motor 145. Motor 145 has a shaft 147 connected to a pinion gear 149. Pinion gear 149 is drivingly connected to a reduction gear 151. The reduction gear 151 is drivably connected to the shaft 129. The shaft 129 passes through bearing 153 and extends through a seal plate 155 having a seal 157. A shaft seal 159 is located just inside a structure on the seal plate 155.

The impeller 123 can be seen as having an impeller plate 163 supporting a series of radial blades 165. An impeller cover plate 167, which also includes an aperture corresponding to the aperture 121 faces the sweeping tips of the radial blades 165. The impeller cover plate 167 provides a more exacting structure for closing the gap between the impeller blades and the structure they oppose for both efficiency and tolerancing.

Also seen are the spacers 67 which help identify and control the width of the gap 75. The impeller blades 165 can be seen and are generally so deep inside the gap 75 that they are inaccessible to being touched. The gap 75 may be about one quarter of an inch and the outermost tips of the impeller blades may be about two inches inside the gap 75 to limit the ability to touch the blades 165.

As can also be seen, the internal side of the bulge 89 in the filter cone housing member 79 and how it accommodates the forward end of the expanded skeletal structure 99 which supports the filter material 107. Further, the poppet valve element 85 is seen as having a pair of rearwardly extending structure 171 as fingers which form a "U" connection for enhanced stability. The rearwardly extending structure 171 includes at least one raised interference structure 173 which limits the outward travel of the poppet valve element 85 and which also retains the poppet valve element 85 within the poppet valve opening 87.

Figure 5:
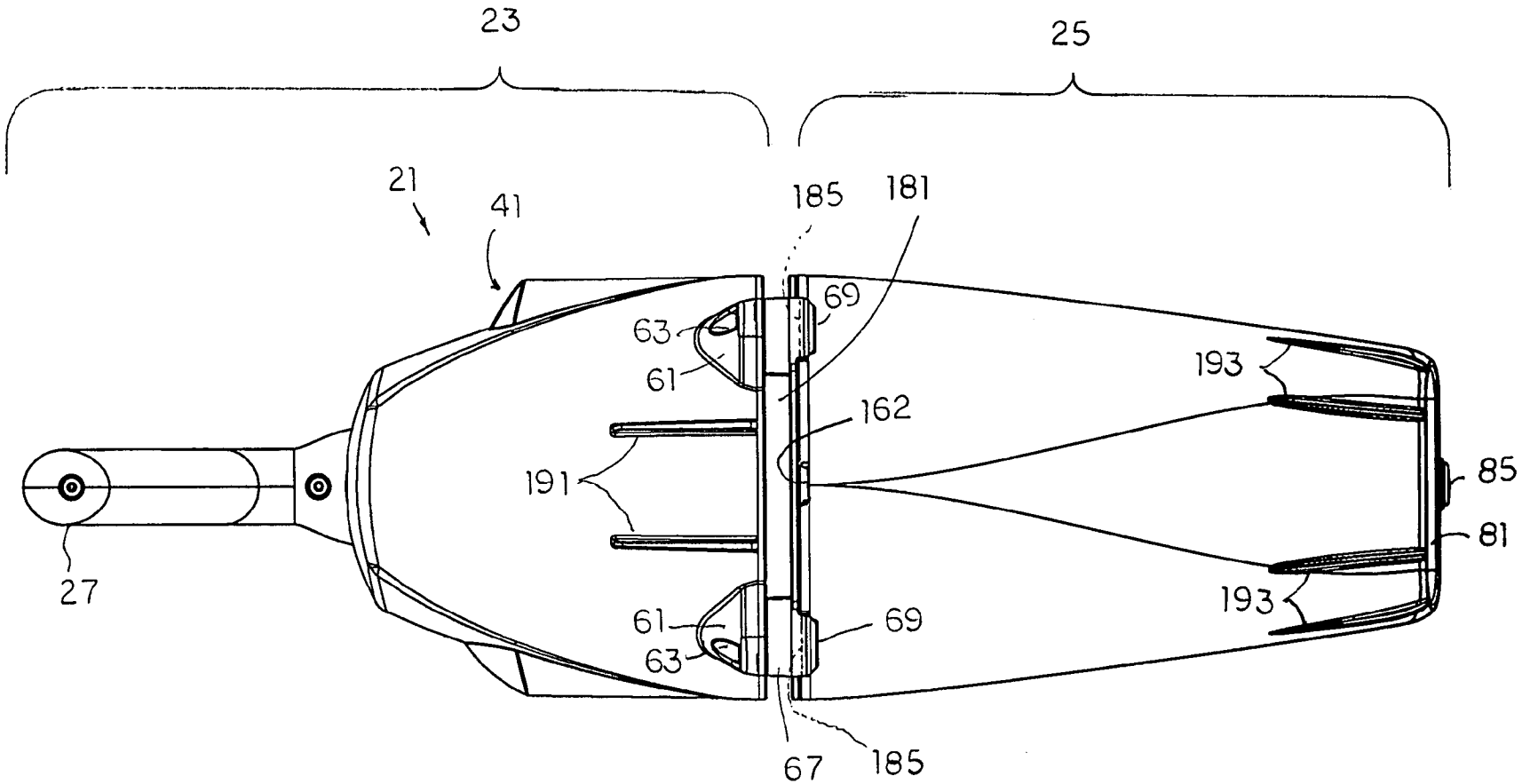
FIG. 5 is a bottom view of the pool vacuum showing the blocking plate which obscures a view of the impeller and blocks bottom thrust.

Referring to FIG. 5 a bottom view illustrates the existence of an obstructive plate 181 which blocks thrust from exiting the bottom of the pool vacuum 21 in order to cause the net overall discharge to be non-symmetrical. Also seen in dashed line format is a matching projection 185 and where two matching projections 185 are captured within the two filter cone housing fittings 69 which are seen in FIG. 5. FIG. 5 also illustrates a set of two wear reinforcement ribs 191 seen on the rear body housing 23, and a set of four wear reinforcement ribs 193 seen on nose-cone shaped front housing section 25. These are the areas expected to have the most incidental movement contact with the underwater surface of a pool or spa, and the wear reinforcement ribs 191 and 193 help isolate the wear to a concentrated raised structure.

Figure 6:
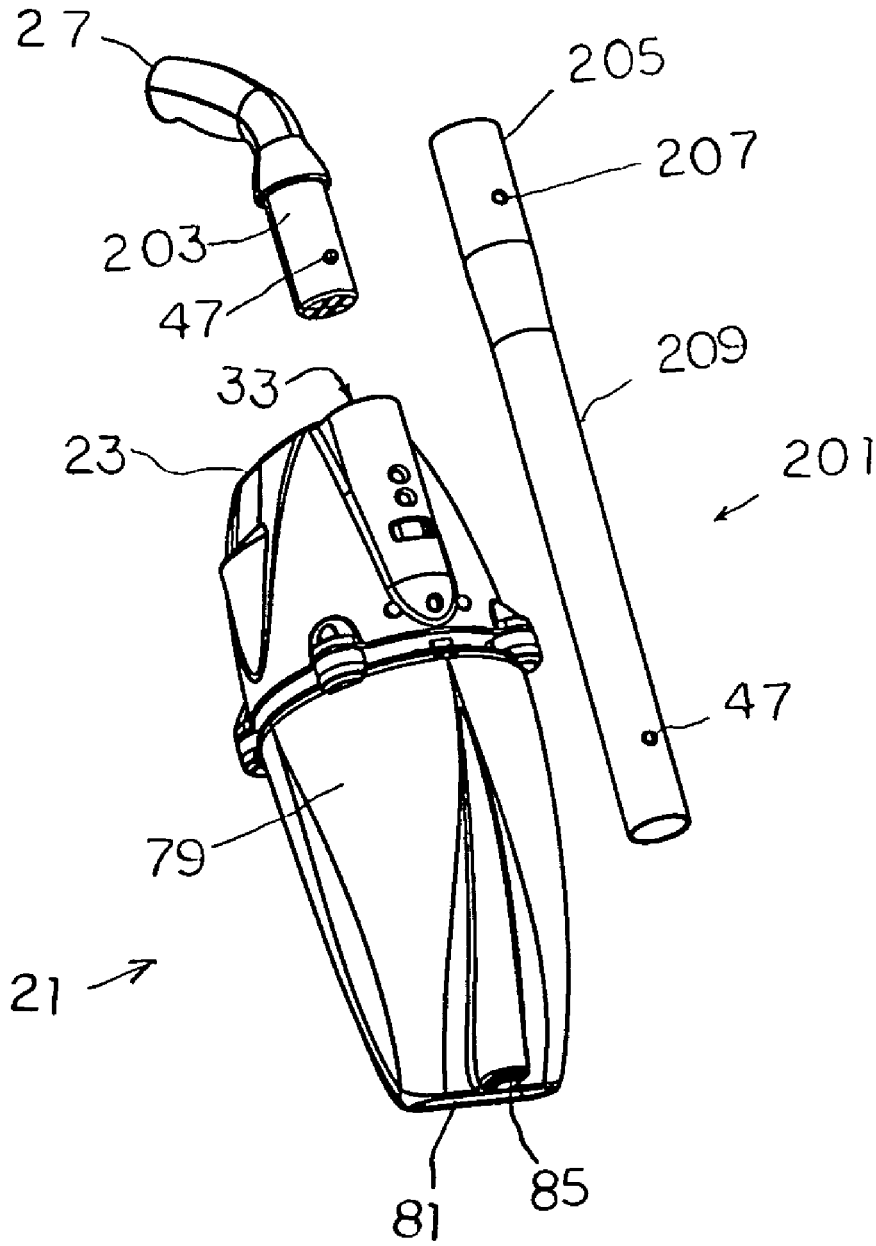
FIG. 6 is a reduced perspective view of the pool vacuum and handle shown disassembled along with a pole which may be of variable lengths as an extension or a standard pool pole to enable vacuuming of a deep pool.

Referring to FIG. 6, a perspective view of the pool vacuum 21 is seen with the handle 27 removed and also pictured with a pole 201 which may be an extension pole of any length or a standard pool pole. As can be seen, the handle 27 has a cylindrical bayonet portion 203 which includes a depressible spring locking button 47 such as was seen in FIG. 1. A second spring locking button 47 (not shown) extends in the opposite direction to allow the handle 27 to be rotated through 180 degrees and locked in a second position. In FIG. 6, the spring locking button 47 has been depressed and the cylindrical bayonet portion 203 withdrawn from the handle bore fitting 33.

The pole 201 seen is an extension pole which is utilizable with the handle 27. The pole 201 is seen as having an optional expanded diameter portion 205, having a spring button locking aperture 207 into which the spring locking button 47 may fit. Pole 201 also has a main cylindrical portion 209 having a spring locking button 47. Where pole 201 is a long pool pole, the structures, including expanded diameter portion 205 and spring button locking aperture 207 may be omitted, as would be practical in a pole with an extremely long length, since actuation would be by grasping the pole rather than by using the handle 27 with it as an extension.

Figure 7:
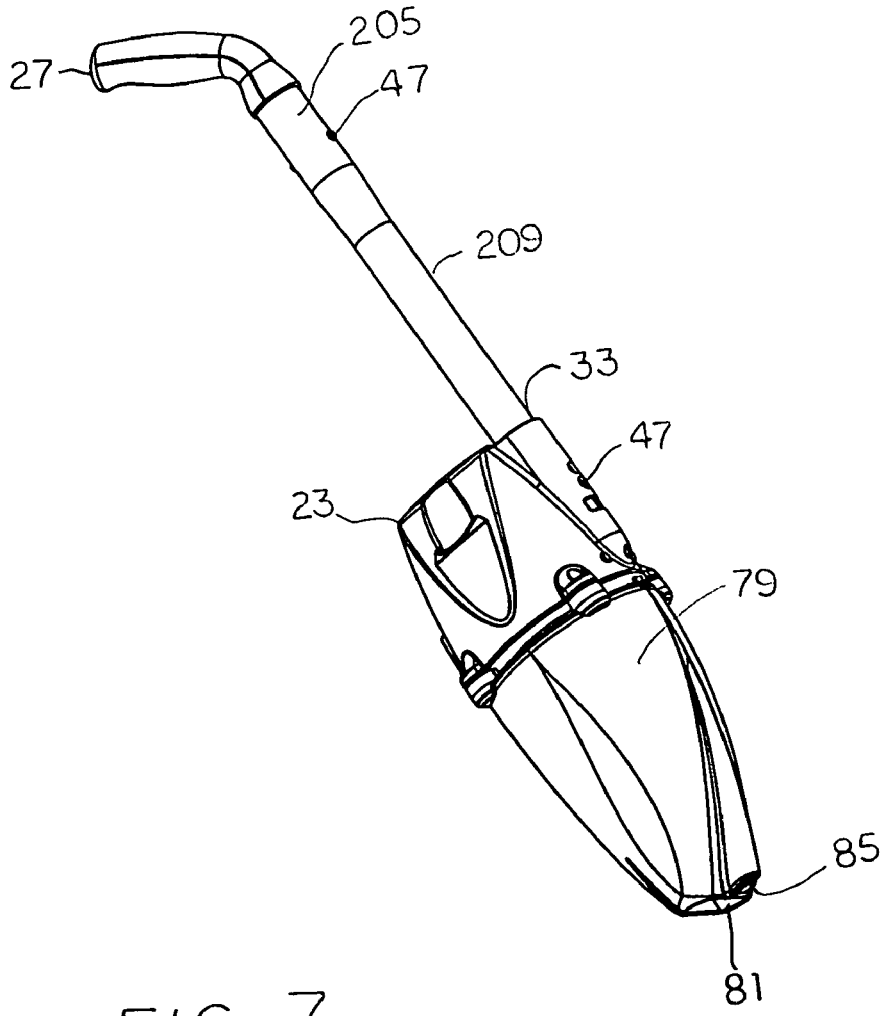
FIG. 7 is a reduced perspective view of the pool vacuum, pole, and handle shown in assembled position with the pole function as an extension member, with extremely long poles more likely to function without the handle.

Referring to FIG. 7 a perspective view of the components seen in FIG. 6 are shown assembled with the handle 27 attached to the pole 201, which is attached into the handle bore fitting 33 so that the pole 201 operates as an extension.

Figure 8:
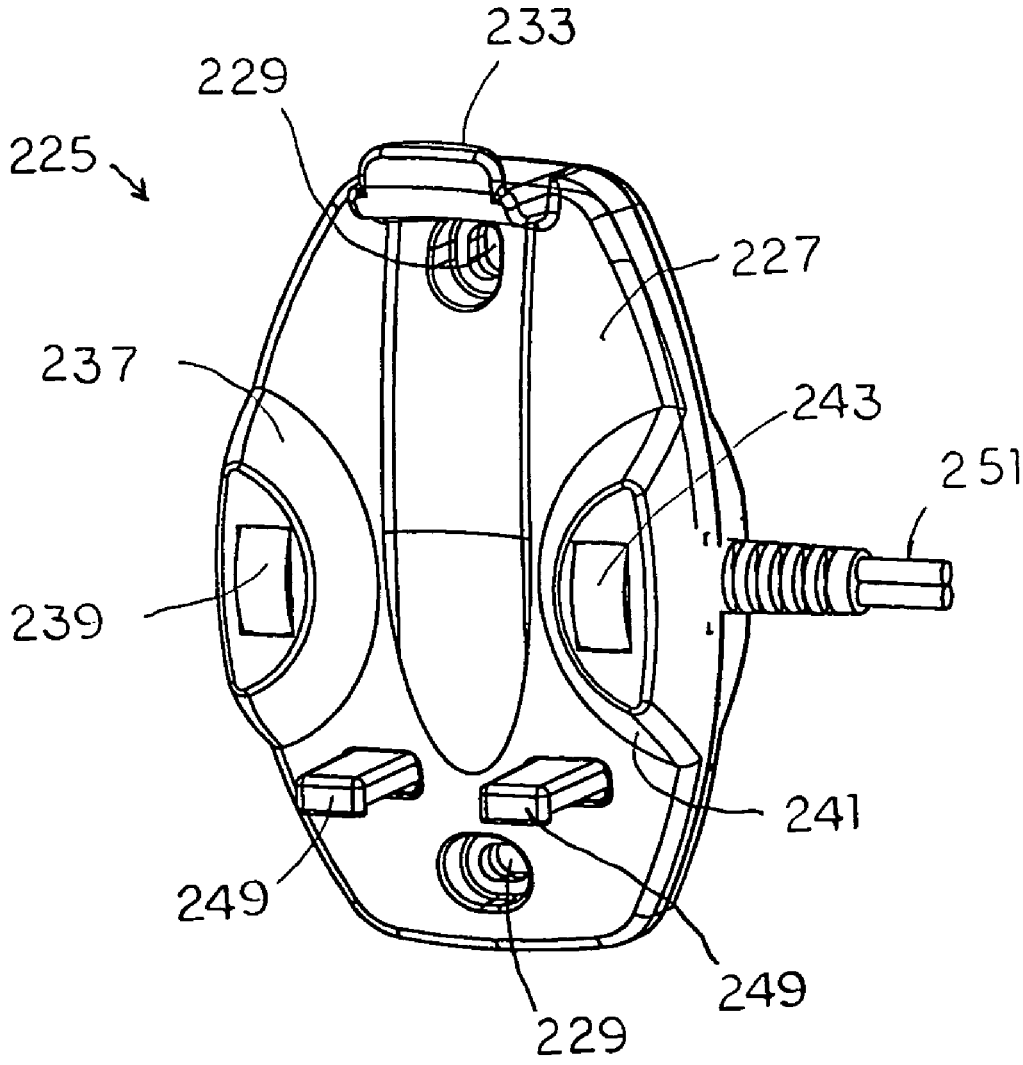
FIG. 8 is a perspective view of a charging bracket which can be wall mounted or used independently.

Referring to FIG. 8, a perspective view of a combination charger and hang bracket 225 can be used as a wall mounted hanger and charger or used independently as a charger. A main bracket body 227 includes a pair of mounting apertures 229 which are countersunk so that an attachment member, such as a nail or screw (not shown) will be able to be inserted below the depth of the surface of the main bracket body 227.

FIG. 8 is illustrated in a position as it might appear for vertical mounting. At the upper end, a main hook 233 should have sufficient strength and thickness to be able to support the weight of the pool vacuum 21. The main hook 233 is sized to fit within the slot 49 seen in FIG. 1. Slot 49 is formed in a curved surface of the top of the pool vacuum 21 and the main hook 233 should either conform to the curvature or have sufficient depth to overcome any curvature of the pool vacuum 21 body.

At the left a first raised area 237 supports a first contact 239. At the right, a second raised area 241 supports a second contact 243. The contacts 239 and 243 are spaced to make contact with different ones of the charging contacts 55. A pair of removable secondary hooks 249 enable the a combination charger and hang bracket 225 to engage the pool vacuum 21 in a non-hanging attachment. The removable secondary hooks 249 can be inserted into the top gap 75 and may engaged a pair of shallow rearward projections 78 on either side of the latch 77 which were seen in FIG. 1. To the right of a combination charger and hang bracket 225 a two conductor supply cord 251 is shown. When the pool vacuum 21 needs to be connected to an electrical power source for recharging purposes, the a combination charger and hang bracket 225 is connected to the pool vacuum 21. To achieve connection, main hook 233 is inserted into hook hole or curved slot 49 in the pool vacuum 21. Secondary hooks 249 are clipped over the two shallow rearward projections 78 to securely fit the combination charger and hang bracket 225 to the pool vacuum 21.

When the combination charger and hang bracket 225 is wall mounted, the weight of the pool vacuum 21 pivoting against the main hook 233 should be sufficient to cause the recharging contacts 55 of the pool vacuum 21 to make contact with the contacts 239 and 243. The secondary hooks 249 can still engage the two shallow rearward projections 78. However for much quicker removal from the mounted combination charger and hang bracket 225, removal of the secondary hooks 249 may be advisable.

Figure 9:
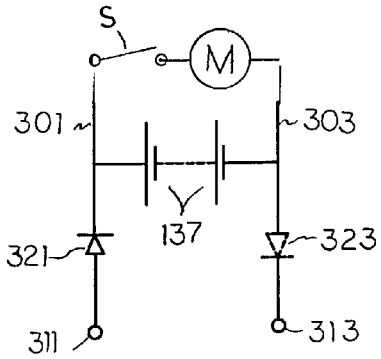
FIG. 9 is a simplified schematic drawing of a first embodiment of a charging circuit which employs one or two diodes to prevent current back-flow, shorting and electrolysis at the external charging terminals.

Referring to FIG. 9, a simplified schematic of the circuitry of the pool vacuum 21 is shown. A motor "M" corresponds to the motor 145 of FIG. 4. A switch "S" corresponds to the switch 141 seen in FIG. 4. The battery 137 is shown with two cell representations separated by a dashed line to indicate that multiple cells may be present (connected in series or in parallel combinations). A positive lead 301 and a negative lead 303 is shown. A positive charging contact 311 and a negative charging contact 313 are shown and correspond to the charging contacts 55 seen in FIG. 1.

In general, the contacts 55 should not interact while the pool vacuum 21 is in use. The pool water may contain electrolytes or salt, and any conductivity between the contacts 55 could result in drainage of the battery through a short circuit between the contacts 55. Therefore, it is preferable for some mechanism to reduce or eliminate any short circuit type current flow between the contacts.

A diode 321 can be placed in the circuit in series between positive lead 301 and the positive charging contact 311 so that no current can flow from positive lead 301 to the negative charging contact 313 through the water in contact with the positive and negative charging contacts 311 and 313. This also prevents an inadvertent short circuit should the positive and negative charging contacts 311 and 313 accidentally contact a conductor. However, during charging, the positive and charging contact 311 has a higher potential than the positive plate of the battery 137 and charging current can flow through the diode 321 and charge the battery. An alternative or additional diode 323 can also be used, as shown. The disadvantage of such an arrangement is that there is a voltage drop across the diodes 321 and 323, typically around 0.7 volts per diode. Further a small trickle current can pass though a diode in reverse bias.

Figure 10:
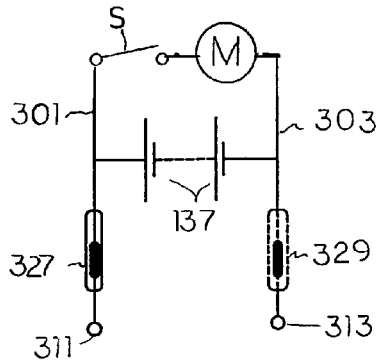
FIG. 10 is a simplified schematic drawing of a second embodiment of a charging circuit which employs one or two reed switches to prevent current back-flow, shorting and electrolysis at the external charging terminals.

FIG. 10 illustrates a circuit similar to that seen in FIG. 9 but with a reed switch 327 which can be placed in the circuit in series between positive lead 301 and the positive charging contact 311 so that the conductive connection between the positive lead 301 and negative charging contact 313 is open circuited. This would eliminate all current either into or out of the internal pool vacuum circuitry to prevent an inadvertent short circuit should the positive and negative charging contacts 311 and 313 accidentally contact a conductor. A magnet (not shown) can be placed inside the combination charger and hang bracket 225 to close the reed switch 327 when the combination charger and hang bracket 225 is brought into close proximity to the area of the pool vacuum adjacent the charging contacts 55. The polarity of the magnet (not shown) and the location of the reed switch 327 underneath the rear body housing 23 adjacent the charging contacts 55 would need to be coordinated to insure that closure of the reed switch 327 when the combination charger and hang bracket 225 is attached. An alternative or additional reed switch 329 can be used, as shown. An advantage of this approach is that there is low voltage drop compared to the circuit in FIG. 9.

Figure 11:
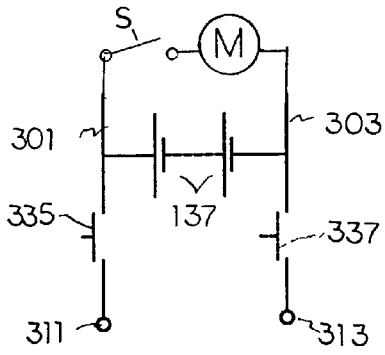
FIG. 11 is a simplified schematic drawing of a first embodiment of a charging circuit which employs one or two momentary contact switches, which may be magnetically operated, to prevent current back-flow, shorting and electrolysis at the external charging terminals.

FIG. 11 illustrates a similar circuit but with the diode 321 of FIG. 9 replaced with a momentary switch 335. A mechanical projection (not shown) can be placed on the combination charger and hang bracket 225 which will close the momentary switch when in contact and allow a charging current to flow. This places the charging contacts 55 in open circuit whenever charging is not occurring. An alternative or additional momentary switch 337 can be used as shown. The physical actuating external contact with the housing of the pool vacuum 21 can be achieved through a sealed membrane similar to the main switch 41 or the momentary switch can be activated by placing a magnetic component on it and using a magnet placed in the charger connector to attract a complementary magnetic component and to close the momentary switch 335. An advantage of this approach is that there is low voltage drop compared to the circuit in FIG. 9.

Figure 12:
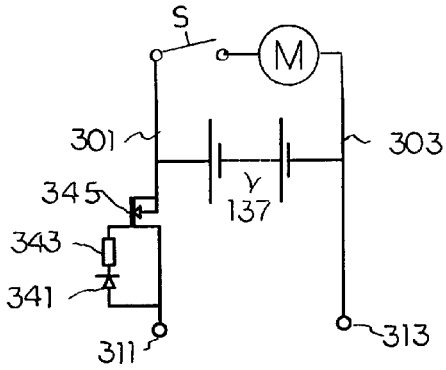
FIG. 12 is a simplified schematic drawing of a first embodiment of a charging circuit which employs a combination of a series connected diode and resistor in parallel and connected to a transistor, with the transistor connected to the positive charging contact to prevent current back-flow, shorting and electrolysis at the external charging terminals.

FIG. 12 shows a circuit similar to that shown in FIG. 9, but similar circuit but with the diode 321 replaced with a series combination diode 341 and resistor 343 connected to a gate of a transistor 345. An input conductor is connected to the current input of the transistor 345. As before, current will not flow in the case of short circuit or immersion in water. However when charging, the potential at positive charging contact 311 will allow the current to open the flow through the transistor 345 and connect the charging current to the battery 137. An advantage of this approach is that there is low voltage drop compared to the circuit in FIG. 9.

While the present invention has been described in terms of a system and method for a pool vacuum which is self draining and includes charging contact isolation and is accessorized to enable use on shallow spas and deep pools, one skilled in the art will realize that the structure and techniques of the present invention can be applied to many structures, including any structure or technique where ease of use, safety, and repetitive storage and deployment are desired to occur in a facilitated manner.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A pool vacuum comprising:

a rear body housing;

a battery supported by said rear body housing;

a motor supported by said rear body housing and electrically connected to said battery;

an output shaft drivably connected to said motor and extending out of said rear body housing;

a front housing section affixed to said rear body housing and defining a gap between said rear body housing and said front housing section, said front housing section further comprising a cone plate attached to said rear body-housing and having a flow aperture; and a filter cone housing member attached to said cone plate; and an impeller attached to said output shaft and rotatable at least partially within said gap to pull water through an opening of said front housing section and expel water through said gap and wherein said output shaft extends through said cone plate flow aperture and further comprising:

an output shaft bearing supported by and spaced apart from a main planar extent of said cone plate; and a strut supporting said output shaft bearing while allowing water to flow through said cone plate flow aperture.

2. The pool vacuum as recited in claim 1 and further comprising:

a pinion gear connected to a motor shaft of said motor; and a reduction gear connected to said output shaft.

3. The pool vacuum as recited in claim 1 and further comprising a obstruction in said gap which causes water discharge from said gap to be non-symmetrical.

4. The pool vacuum as recited in claim 1 and further comprising a flap valve adjacent said opening of said front housing section to prevent back flow of debris when said pool vacuum is not operating.

5. The pool vacuum as recited in claim 1 and further comprising pair of charging contacts protruding to an exterior of said rear body housing.

6. The pool vacuum as recited in claim 1 and further comprising a support slot on said rear body housing for enabling said pool vacuum to be hangably stored when not in use.

7. The pool vacuum as recited in claim 1 wherein said rear body housing includes a handle bore fitting and further comprising a handle having a locking means for fixed attachment and fittable within said handle bore fitting.

8. The pool vacuum as recited in claim 7 and further comprising a pole interfittable between said handle and said handle bore fitting of said rear body housing.

9. The pool vacuum as recited in claim 1 and further comprising a membrane switch carried on said rear body housing and electrically connected between said motor and said battery.

10. A pool vacuum comprising:

a rear body housing;

a battery supported by said rear body housing;

a motor supported by said rear body housing and electrically connected to said battery;

an output shaft drivably connected to said motor and extending out of said rear body housing;

a front housing section affixed to said body and defining a gap between said rear body housing and said front section; and an impeller attached to said output shaft and rotatable at least partially within said gap to pull water through an opening of said front housing section and expel water through said gap;

a cone plate attached to said-rear body housing and having a flow aperture positioned adjacent said impeller; and a filter cone housing member attached to said cone plate;

a plurality of filter cone housing fittings depending from said rear body housing and having slots which open toward a centerline of said pool vacuum; and a matching projection attached to said filter cone housing member and wherein said filter cone housing member is rotatable against said cone plate to cause said matching projections capture within said slots of said plurality of filter cone housing fittings to cause said filter cone housing to be supported by said cone plate; and a latch springingly supported by said cone plate for interfitting in a complementary slot carried by said filter cone housing for preventing said filter cone housing from turning when matching projections to become captured within said slots of said plurality of fittings.

11. The pool vacuum as recited in claim 10 and wherein said rear body housing and further comprising:

a pinion gear connected to a motor shaft of said motor; and a reduction gear connected to said output shaft.

12. A pool vacuum comprising:

a rear body housing;

a battery supported by said rear body housing;

a motor supported by said rear body housing and electrically connected to said battery;

an output, shaft drivably connected to said motor and extending out of said rear body housing;

a front housing section affixed to said rear body housing and defining a gap between said rear body housing and said front housing section; and an impeller attached to said output shaft and rotatable at least partially within said gap to pull water through an opening of said front housing section and expel water through said gap;

an expanded skeletal structure attached to said rear body housing and extending into said front housing section and including structural support members having interstitial water passages; and an area of fitter material supported by said expanded skeletal structure and covering said interstitial water passages to filter water passing through said interstitial water passages.

13. The pool vacuum as recited in claim 12 and wherein said expanded skeletal structure has an opening not covered by said area of fitter material and further comprising:

a drainage valve having an input in communication with said opening of said skeletal structure, and an output, for draining filtered water from within said expanded skeletal structure.

14. The pool vacuum as recited in claim 13 wherein said drainage valve is a poppet valve which pulls itself into a closed shut position whenever said pool vacuum is operated and which opens to drain under the influence of gravity when poppet valve is downwardly directed when said pool vacuum is removed from a body of water.

15. A pool vacuum comprising:

a rear body housing, and wherein said rear body housing includes a pair of charging contacts spaced apart from a support slot, and further including a combination charger and hang bracket further comprising:

a main bracket body;

main hook extending from said main bracket body for engaging said support slot of said pool vacuum;

a pair of charger bracket contacts supported by said main bracket body, arranged for physical alignment with said charging contacts of said pool vacuum and a pair of power supply conductors electrically connected to respective ones of said charger bracket contacts, said pair of power supply conductors for connection to a source of electrical power;

a battery supported by said rear body housing;

a motor supported by said rear body housing and electrically connected to said battery;

an output shaft drivably connected to said motor and extending out of said rear body housing;

a front housing section affixed to said body and defining a gap between said rear body housing and said front section; and an impeller attached to said output shaft and rotatable at least partially within said gap to pull water through an opening of said front housing section and expel water through said gap.

16. The pool vacuum as recited in claim 15 and further comprising at least one secondary hook extending from said main bracket body and spaced apart from said main hook, for engaging structures adjacent said gap to hold said combination charger and hang bracket in place on said pool vacuum without having to mount said combination charger and hang bracket on another support structure.

* * * * *